US010560793B2

(12) United States Patent
Little et al.

(10) Patent No.: US 10,560,793 B2
(45) **Date of Patent: *Feb. 11, 2020**

(54) TRANSDUCER ASSEMBLY

(71) Applicant: Sonos, Inc., Santa Barbara, CA (US)

(72) Inventors: Richard Warren Little, Santa Barbara, CA (US); Daniel Liu, Shenzhen (CN); Derrick Pierce, Santa Barbara, CA (US); Ernie Latham-Brown, Boston, MA (US)

(73) Assignee: Sonos, Inc., Santa Barbara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/949,014

(22) Filed: Apr. 9, 2018

(65) Prior Publication Data

US 2018/0227689 A1 Aug. 9, 2018

Related U.S. Application Data

(63) Continuation of application No. 15/049,200, filed on Feb. 22, 2016, now Pat. No. 9,942,680.

(51) Int. Cl.

| | |
|---|---|
| ***H04R 9/00*** | (2006.01) |
| ***H04R 31/00*** | (2006.01) |
| ***H04R 1/06*** | (2006.01) |
| ***H04R 9/06*** | (2006.01) |

(52) U.S. Cl.
CPC ..... *H04R 31/006* (2013.01); *H04R 1/06* (2013.01); *H04R 9/06* (2013.01)

(58) Field of Classification Search
CPC .... H04R 9/00; H04R 29/003; H04R 2209/00; H04R 2209/41
USPC ..... 381/404
See application file for complete search history.

(56) References Cited

U.S. PATENT DOCUMENTS

| | | | | |
|---|---|---|---|---|
| 1,898,441 | A | 2/1933 | Grunow | |
| 1,944,861 | A | 1/1934 | Puy | |
| 2,010,529 | A | 8/1935 | Urk | |
| 2,197,649 | A | 4/1940 | Neuschotz | |
| 2,303,989 | A | 12/1942 | Cunningham | |
| 2,922,850 | A | 1/1960 | Zuerker | |
| 3,125,647 | A * | 3/1964 | Rouy ..... | H04R 7/12 181/166 |
| 3,711,659 | A | 1/1973 | Bremseth | |
| 5,440,644 | A | 8/1995 | Farinelli et al. | |
| 5,761,320 | A | 6/1998 | Farinelli et al. | |

(Continued)

FOREIGN PATENT DOCUMENTS

| | | | |
|---|---|---|---|
| EP | 1389853 | A1 | 2/2004 |
| WO | 200153994 | | 7/2001 |
| WO | 2003093950 | A2 | 11/2003 |

OTHER PUBLICATIONS

Advisory Action dated Oct. 24, 2017, issued in connection with U.S. Appl. No. 15/049,200, filed Feb. 22, 2016, 5 pages.

(Continued)

*Primary Examiner* — Suhan Ni

(57) ABSTRACT

A diaphragm for a loudspeaker may include a conductive coupler, a voice coil having a voice coil lead, where the voice coil lead is positioned in conductive contact with the conductive coupler, and a terminal lead, where the terminal lead is positioned in conductive contact with the conductive coupler, and where the voice coil lead and the terminal lead are attached to the conductive coupler.

14 Claims, 4 Drawing Sheets

(56) References Cited

U.S. PATENT DOCUMENTS

| | | | | |
|---|---|---|---|---|
| 5,838,809 | A | 11/1998 | Sato et al. | |
| 5,923,902 | A | 7/1999 | Inagaki | |
| 6,032,202 | A | 2/2000 | Lea et al. | |
| 6,256,554 | B1 | 7/2001 | Dilorenzo | |
| 6,269,167 | B1 | 7/2001 | Mango, III et al. | |
| 6,404,811 | B1 | 6/2002 | Cvetko et al. | |
| 6,469,633 | B1 | 10/2002 | Wachter | |
| 6,522,886 | B1 | 2/2003 | Youngs et al. | |
| 6,526,152 | B2 | 2/2003 | Frasl | |
| 6,611,537 | B1 | 8/2003 | Edens et al. | |
| 6,631,410 | B1 | 10/2003 | Kowalski et al. | |
| 6,757,517 | B2 | 6/2004 | Chang | |
| 6,778,869 | B2 | 8/2004 | Champion | |
| 7,130,608 | B2 | 10/2006 | Hollstrom et al. | |
| 7,130,616 | B2 | 10/2006 | Janik | |
| 7,143,939 | B2 | 12/2006 | Henzerling | |
| 7,197,154 | B2 * | 3/2007 | Sahyoun ..... | H04R 7/12 381/403 |
| 7,236,773 | B2 | 6/2007 | Thomas | |
| 7,295,548 | B2 | 11/2007 | Blank et al. | |
| 7,483,538 | B2 | 1/2009 | McCarty et al. | |
| 7,571,014 | B1 | 8/2009 | Lambourne et al. | |
| 7,630,501 | B2 | 12/2009 | Blank et al. | |
| 7,643,894 | B2 | 1/2010 | Braithwaite et al. | |
| 7,657,910 | B1 | 2/2010 | Mcaulay et al. | |
| 7,853,341 | B2 | 12/2010 | McCarty et al. | |
| 7,987,294 | B2 | 7/2011 | Bryce et al. | |
| 8,014,423 | B2 | 9/2011 | Thaler et al. | |
| 8,045,952 | B2 | 10/2011 | Qureshey et al. | |
| 8,103,009 | B2 | 1/2012 | McCarty et al. | |
| 8,234,395 | B2 | 7/2012 | Millington et al. | |
| 8,483,853 | B1 | 7/2013 | Lambourne | |
| 9,363,593 | B2 | 6/2016 | Kawka et al. | |
| 9,446,559 | B2 | 9/2016 | Popken et al. | |
| 2001/0042107 | A1 | 11/2001 | Palm | |
| 2002/0022453 | A1 | 2/2002 | Balog et al. | |
| 2002/0026442 | A1 | 2/2002 | Lipscomb et al. | |
| 2002/0124097 | A1 | 9/2002 | Isely et al. | |
| 2003/0144586 | A1 | 7/2003 | Tsubata | |
| 2003/0157951 | A1 | 8/2003 | Hasty | |
| 2004/0024478 | A1 | 2/2004 | Hans et al. | |
| 2007/0142944 | A1 | 6/2007 | Goldberg et al. | |
| 2017/0026757 | A1 | 1/2017 | Stolz et al. | |

OTHER PUBLICATIONS

AudioTron Quick Start Guide, Version 1.0, Mar. 2001, 24 pages.
AudioTron Reference Manual, Version 3.0, May 2002, 70 pages.
AudioTron Setup Guide, Version 3.0, May 2002, 38 pages.
Bluetooth. "Specification of the Bluetooth System: The ad hoc SCATTERNET for affordable and highly functional wireless connectivity," Core, Version 1.0 A, Jul. 26, 1999, 1068 pages.
Bluetooth. "Specification of the Bluetooth System: Wireless connections made easy," Core, Version 1.0 B, Dec. 1, 1999, 1076 pages.
Dell, Inc. "Dell Digital Audio Receiver: Reference Guide," Jun. 2000, 70 pages.
Dell, Inc. "Start Here," Jun. 2000, 2 pages.
"Denon 2003-2004 Product Catalog," Denon, 2003-2004, 44 pages.
Final Office Action dated Aug. 4, 2017, issued in connection with U.S. Appl. No. 15/049,200, filed Feb. 22, 2016, 7 pages.
Jo et al., "Synchronized One-to-many Media Streaming with Adaptive Playout Control," Proceedings of SPIE, 2002, pp. 71-82, vol. 4861.
Jones, Stephen, "Dell Digital Audio Receiver: Digital upgrade for your analog stereo," Analog Stereo, Jun. 24, 2000 retrieved Jun. 18, 2014, 2 pages.
Louderback, Jim, "Affordable Audio Receiver Furnishes Homes With MP3," TechTV Vault. Jun. 28, 2000 retrieved Jul. 10, 2014, 2 pages.
Notice of Allowance dated Nov. 29, 2017, issued in connection with U.S. Appl. No. 15/049,200, filed Feb. 22, 2016, 5 pages.
Palm, Inc., "Handbook for the Palm VII Handheld," May 2000, 311 pages.
Preinterview First Office Action dated Mar. 29, 2017, issued in connection with U.S. Appl. No. 15/049,200, filed Feb. 22, 2016, 5 pages.
Presentations at WinHEC 2000, May 2000, 138 pages.
Stolz et al., U.S. Appl. No. 14/804,208, entitled Voice Coil Wire Configurations, filed Jul. 20, 2015, 39 pages.
United States Patent and Trademark Office, U.S. Appl. No. 60/490,768 filed Jul. 28, 2003, entitled "Method for synchronizing audio playback between multiple networked devices," 13 pages.
United States Patent and Trademark Office, U.S. Appl. No. 60/825,407 filed Sep. 12, 2006, entitled "Controlling and manipulating groupings in a multi-zone music or media system," 82 pages.
UPnP; "Universal Plug and Play Device Architecture," Jun. 8, 2000; version 1.0; Microsoft Corporation; pp. 1-54.
U.S. Appl. No. 14/490,625, entitled Speaker Terminals, filed Sep. 18, 2014, 38 pages.
Yamaha DME 64 Owner's Manual; copyright 2004, 80 pages.
Yamaha DME Designer 3.5 setup manual guide; copyright 2004, 16 pages.
Yamaha DME Designer 3.5 User Manual; Copyright 2004, 507 pages.

* cited by examiner

TRANSDUCER ASSEMBLY

The present application is a continuation of U.S. application Ser. No. 15/049,200 filed Feb. 22, 2016. The disclosure is related to consumer goods and, more particularly, to methods, systems, products, features, services, and other elements directed to media playback or some aspect thereof.

FIELD OF THE DISCLOSURE

Background

A loudspeaker in the context of the present application is an electroacoustic transducer that produces sound in response to an electrical audio signal input. Originally, non-electrical loudspeakers were developed as accessories to telephone systems. Today, electronic amplification for applications such as audible communication and enjoyment of music has made loudspeakers ubiquitous.

A common form of loudspeaker uses a diaphragm (such as, for example, a paper cone) supporting a voice coil electromagnet acting on a permanent magnet. Based on the application of the loudspeaker, different parameters may be selected for the design of the loudspeaker. For instance, the frequency response of sound produced by a loudspeaker may depend on the shape, size, and rigidity of the diaphragm, and efficiency of the voice coil electromagnet, among other factors. Accordingly, the diaphragm and voice coil electromagnet may be selected based on a desired frequency response of the loudspeaker. In some cases, for improved reproduction of sound covering a wide frequency range, multiple loudspeakers may be used collectively, each configured to optimally reproduce different frequency subranges within the wide frequency range.

As applications of loudspeakers continue to broaden, different loudspeakers designed for particular applications continue to be developed.

BRIEF DESCRIPTION OF THE DRAWINGS

Features, aspects, and advantages of the presently disclosed technology may be better understood with regard to the following description, appended claims, and accompanying drawings where:

Figure 1:
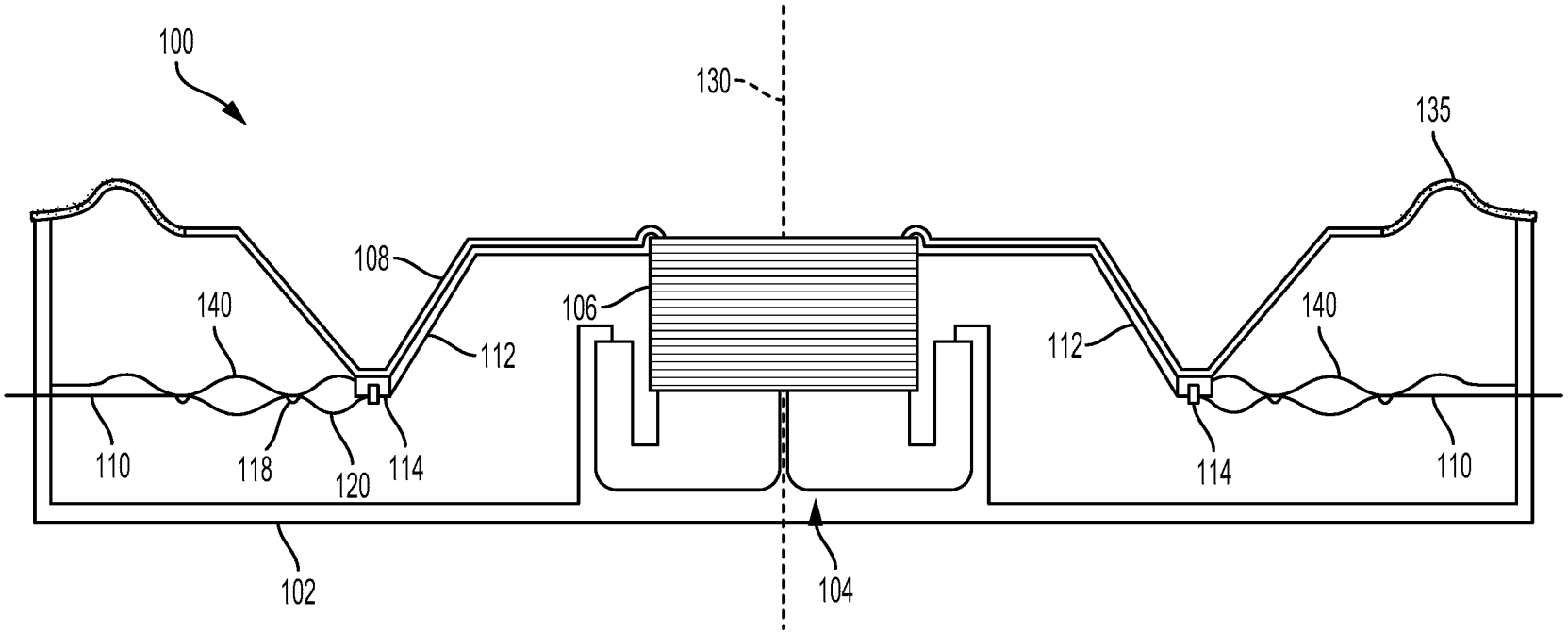
FIG. 1 shows an example configuration of a loudspeaker, according to an example embodiment.

The drawings are for the purpose of illustrating example embodiments and are not necessarily to scale. It is understood that the inventions are not limited to the arrangements and instrumentalities shown in the drawings.

DETAILED DESCRIPTION

I. Overview

Examples described herein involve configurations of a loudspeaker that may allow for easier and more consistent assembly of the loudspeaker. In particular, the loudspeaker may contain one or more terminals to receive an audio signal input. The audio signal input may then pass from the terminal to a terminal lead, or wire, which may be connected within the loudspeaker to a voice coil lead. The voice coil lead then carries the signal to the voice coil, which drives the audio output of the loudspeaker by vibrating a transducer diaphragm. Examples herein describe a pre-positioned conductive coupler for joining the terminal lead and the voice coil lead within the loudspeaker.

In a conventional loudspeaker, the terminal lead and the voice coil lead may be connected by soldering the two freestanding wires together. In some cases, the soldered connection may then be attached to a component of the loudspeaker, such as a suspension element (or spider), often using the solder as an adhesive to do so. This process may be subject to a fair amount of human error, as well as variation in the quality of connections. An inadequate connection or a weak connection that fails over time may create fault problems within the loudspeaker, and may result in the loudspeaker not functioning properly. Further, the inexact or unnecessary application of solder to the interior components of the loudspeaker, many of which are intended to be flexible, may be undesirable for both the loudspeaker component as well as the intended solder joint.

Instead, a conductive coupler may be attached to the loudspeaker at a predetermined location. The location may be chosen based on the particular configuration of the loudspeaker in question and the relative ease of assembly. For instance, the conductive coupler may be a mechanical clip positioned on the inner diameter of the spider. Other locations are also possible, such as the transducer cone or diaphragm of the loudspeaker, or the frame of the loudspeaker.

The conductive coupler may provide a relatively easy and consistent way to join the terminal lead and the voice coil lead and hold them in conductive contact with each other. For example, both leads may be positioned within the clip, and then the clip may be engaged against the leads. Further, the conductive coupler may provide a ready destination for the application of solder to create a solder joint connecting the terminal lead, voice coil lead, and conductive coupler. In some cases, the conductive coupler may take the form of a solder pad, rather than a clip. For instance, the two leads may be positioned in contact with the pad and then solder may be melted to create a solder joint.

Additionally, in some examples, the conductive coupler may also serve to securely anchor the terminal lead on one side of a service loop that may be formed in the terminal lead. The service loop may allow the terminal lead to be attached to a bottom surface of the spider while still allowing the spider to flex as expected during operation of the loudspeaker.

As indicated above, the examples involve a pre-positioned conductive coupler for joining a terminal lead and a voice coil lead within a loudspeaker. In one aspect, a method of assembling a loudspeaker is provided. The method includes (i) attaching a conductive coupler to the loudspeaker, (ii) positioning a voice coil lead of the loudspeaker in conductive contact with the conductive coupler, (iii) positioning a terminal lead of the loudspeaker in conductive contact with the conductive coupler; and (iv) while the voice coil lead and the terminal lead are in conductive contact with the conductive coupler, attaching the voice coil lead and the terminal lead to the conductive coupler.

In another aspect, a loudspeaker is provided. The loudspeaker includes a conductive coupler, a voice coil having a voice coil lead, where the voice coil lead is positioned in conductive contact with the conductive coupler, and a terminal lead, where the terminal lead is positioned in conductive contact with the conductive coupler, and where the voice coil lead and the terminal lead are attached to the conductive coupler.

In yet another aspect, a loudspeaker is provided. The loudspeaker includes a frame, a voice coil suspended at least partially within a gap of a magnetic structure, where the magnetic structure is attached to the frame, and where the voice coil comprises a voice coil lead extending from the voice coil, a diaphragm coupled to the voice coil, a first suspension element attached circumferentially to an outer edge of the primary diaphragm, where the first suspension element is further attached to the frame, a second suspension element attached circumferentially to a lower surface of the primary diaphragm, where the second suspension element is further attached to the frame, a conductive coupler, and a terminal lead, where the terminal lead and the voice coil lead are positioned in conductive contact with the conductive coupler, and where the voice coil lead and the terminal lead are attached to the conductive coupler.

It will be understood by one of ordinary skill in the art that this disclosure includes numerous other embodiments. It will be understood by one of ordinary skill in the art that this disclosure includes numerous other examples. While some examples described herein may refer to functions performed by given actors such as "users" and/or other entities, it should be understood that this description is for purposes of explanation only. The claims should not be interpreted to require action by any such example actor unless explicitly required by the language of the claims themselves.

While some examples described herein may refer to functions performed by given actors such as "users" and/or other entities, it should be understood that this is for purposes of explanation only. The claims should not be interpreted to require action by any such example actor unless explicitly required by the language of the claims themselves.

II. Example Loudspeaker Configuration and Assembly

As discussed above, embodiments described herein may involve configurations of a loudspeaker and the assembly thereof. Method 300 in FIG. 3 may include one or more operations, functions, or actions as illustrated by one or more of blocks 302-308. Although the blocks are illustrated in sequential order, these blocks may also be performed in parallel, and/or in a different order than those described herein. Also, the various blocks may be combined into fewer blocks, divided into additional blocks, and/or removed based upon the desired implementation.

In addition, for the method 300 and other processes and methods disclosed herein, the flowchart shows functionality and operation of one possible implementation of present embodiments. In this regard, each block may represent a module, a segment, or a portion of program code, which includes one or more instructions executable by one or more processors for implementing logical functions or steps in the process. For example, a processor may execute the instructions to cause one or more pieces of machinery to carry out the loudspeaker assembly.

The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device. In addition, for the method 300 and other processes and methods disclosed herein, each block in FIG. 3 may represent circuitry and/or machinery that is wired or arranged to perform the specific functions in the process.

a. Example Loudspeaker Configurations

Figure 2A:
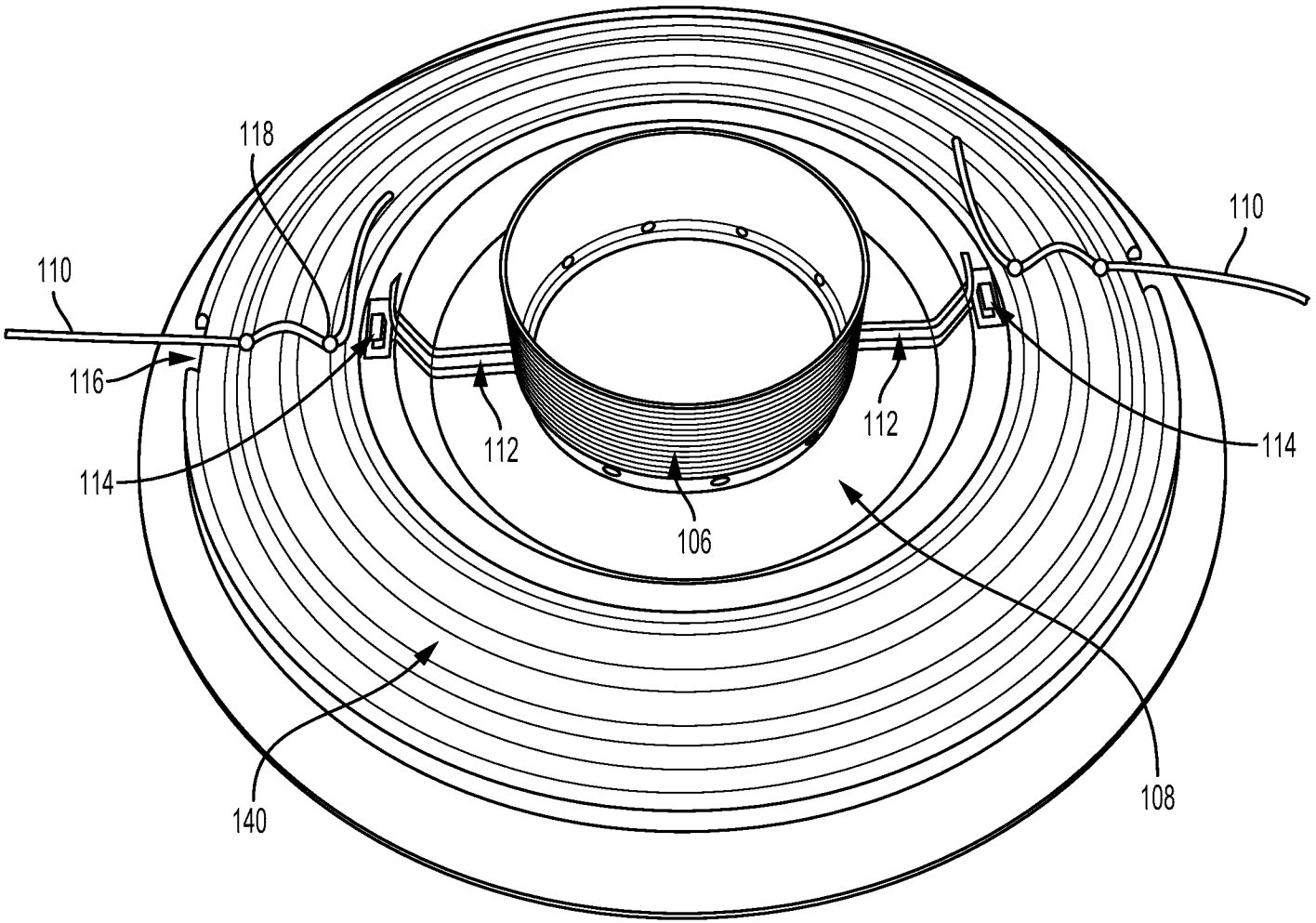
FIGS. 2A-2B show an example configuration of a loudspeaker, according to an example embodiment.
Figure 2B:
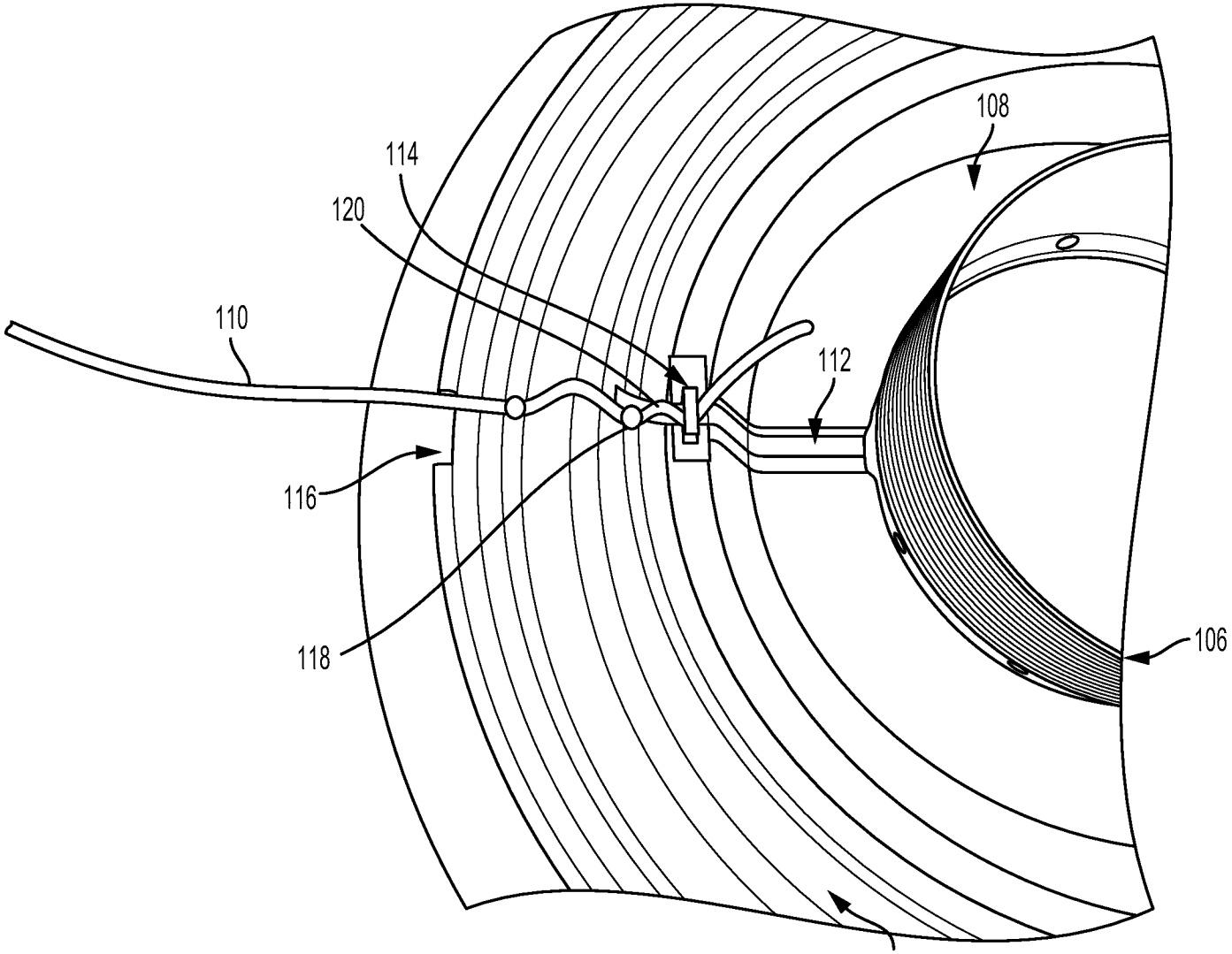

FIGS. 1, 2A and 2B show examples of a loudspeaker according to an embodiment. In particular, FIG. 1 shows an example loudspeaker 100 including components that are generally symmetric about a center axis 130, including a frame 102 and a magnetic structure 104 attached to the frame 102. A voice coil 106 may be suspended at least partially with a gap of the magnetic structure 104, and may move along an internal portion of the magnetic structure 104 in response to an electrical signal. The movement of the voice coil 106 may cause a corresponding movement of a diaphragm 108, generating sound. The diaphragm 108 may be formed from aluminum, paper, plastic, or a composite material, among other possibilities. The diaphragm 108 may be circular in shape (as shown more clearly in FIGS. 2A-2B), and may be coupled to the voice coil 106.

The loudspeaker 100 may also include a suspension system configured to keep the voice coil 106 centered in the magnetic gap of the magnetic structure 104, and to provide a restoring force to return the diaphragm 108 to a neutral position after movements of the diaphragm 108 responsive to vibrations of the voice coil 106. The suspension system may include a first suspension element 135 attached circumferentially to an outer edge of the primary diaphragm 108. The first suspension element 135, also known as a "surround," is further attached to the frame 102, and may be made of rubber, polyester foam, or corrugated, resin coated fabric, for example. Other materials may also be possible. The sound output level and frequency response of the loudspeaker 100 may be dependent on the material and dimensions of the surround 135.

The suspension system may also include a second suspension element 140 attached circumferentially to a lower surface of the diaphragm 108. The second suspension element 140, also known as a "spider" 140, may be attached to the diaphragm 108 with an adhesive substance. In some cases, the spider 140 may be alternatively attached to the voice coil 106. The spider 140 may be further attached to the frame 102. The spider 140 may be made of a treated fabric material, flexible rubber, or flexible elastomer, for example. Other materials may also be possible. The sound output level and frequency response of the loudspeaker 100 may be dependent on the material and dimensions of the spider 140. In one example, the spider 140 may have a concentrically corrugated structure.

The loudspeaker 100 may further include one or more terminals to accept audio input signals for the loudspeaker 100. Each terminal may be located, for example, outside of the frame 102. A terminal lead 110, or wire, may be connected to the terminal and may carry the audio input signal into the loudspeaker 100. As shown in FIG. 1, the terminal lead 110 may enter the frame 102, for example, along a side of the frame 102. In some cases, each terminal may extend through the frame 102 such that the input can be connected outside the frame 102, and the terminal lead 110 may be connected to a back of the terminal on the inside of the frame 102. Other configurations are also possible.

The terminal lead 110 may be conductively coupled to a voice coil lead 112, which may extend from the voice coil 106 and carry the audio input signal from the terminal lead 110 to the voice coil 106. The connection of the terminal lead 110 to the voice coil lead 112 may occur in many possible locations. For example, as shown in Figures, the terminal lead 110 and the voice coil lead 112 may be connected at an inner diameter of the spider 140. Other locations are also possible, as further discussed below.

At the connection point between the terminal lead 110 and the voice coil lead 112, a conductive coupler 114 may be provided. As shown in FIG. 2A, the conductive coupler 114 may be a mechanical clip that can be engaged by, for instance, bending the clip. In FIG. 2A, which may represent an intermediate stage in the assembly of the loudspeaker 100, the two leads are not yet connected. However, during assembly of the loudspeaker 100, the terminal lead 110 and the voice coil lead 112 may be positioned in conductive contact with the conductive coupler 114 and then attached to the conductive coupler 114. For example, as shown in FIG. 2B, the two leads are attached to the conductive coupler 114 via engagement of the mechanical clip. In some cases, the excess wire may be trimmed from both leads after the attachment.

The conductive coupler 114 may take other forms as well. For instance, other mechanical couplers are also possible, such as a spring-loaded clip, or a bendable or hinged fastener that may snap closed. In some cases, the conductive coupler 114 might not be movable to fasten the leads to the coupler, as described thus far. Instead, the conductive coupler 114 may be a hook or ring through which the terminal lead 110 and the voice coil lead 112 might be passed, which may serve to hold the leads in position until solder is applied. Moreover, soft solder may be added to the other mechanical-type couplers discussed above as well, creating a solder joint after the terminal lead 110 and the voice coil lead 112 are attached.

In another embodiment, the conductive coupler 114 may take the form of a solder pad. The terminal lead 110 and the voice coil lead 112 may then be attached to the solder pad via heating of the pad and associated solder, forming a solder joint. In some cases, the solder pad may include an adhesive solder paste, which may hold the two leads in place on the solder pad while the pad is heated and the solder joint is created.

Regardless of its form, the conductive coupler 114 may be pre-positioned on and attached to the loudspeaker 100 during assembly, before the leads are connected to one another. The conductive coupler 114 may be attached to the loudspeaker 100 using an adhesive, for example. Numerous locations are possible, depending on the configuration of the particular loudspeaker and the relative ease of assembly of a particular location. In addition to the example shown in the Figures, the conductive coupler 114 may be attached to a bottom surface of the diaphragm 108. Alternatively, the conductive coupler 114 may be attached to an outer diameter of the spider 140, or possibly to the frame 102. Other possibilities also exist.

In some cases, where the conductive coupler 114 is located inside the frame 102 and within an outer diameter of the spider 140, the spider 140 might be adapted to accommodate the path of terminal lead 110. For example, the spider 140 may include a gap 116 at its outer diameter, as shown in FIG. 2B. The conductive coupler 114 may be attached to the spider 140 at its inner diameter, for instance, in radial alignment with the gap 116. Accordingly, the terminal lead 110 may be positioned in the gap 116 of the spider 140. Alternatively, in an embodiment where the conductive coupler 114 is located on the frame 102, the voice coil lead 112 might extend from the voice coil 106 and pass across the spider 140 and through the gap 116.

The conductive coupler 114 may also serve to constrain the movement of the terminal lead 110 during operation of the loudspeaker 100. For example, the loudspeaker diaphragm 106 is subject to excursion, or vibrational movement, during operation of the loudspeaker 100. The spider 140, which is attached to and partially suspending the voice coil 106, is also subject to the same excursion. Therefore, in the example loudspeaker 100 as shown in the Figures, where the terminal lead 110 extends across the spider 140 to reach the connection with the voice coil lead 112, it may be desirable to attach the terminal lead 110 to the bottom side of the spider 140. If the terminal lead 110 is not attached to the spider 140 in some way, the excursion of the spider 140 during operation may result in the terminal lead 110 shaking and even bouncing up and down off of the spider 140 as the spider 140 vibrates. This may stress the connection with the voice coil lead 112, as well as affect the acoustic properties of the spider 140 and diaphragm 108.

Therefore, the terminal lead 110 may be attached to a bottom surface of the spider 140 at one or more connection points. For example, the spider 140 may have a corrugated structure as shown in the Figures, and the terminal lead 110 may be attached at a connection point 118 at the top of each consecutive corrugation. The terminal lead 110 may be attached using a small amount of adhesive, such as glue, for instance. Other adhesives and other types of connections are also possible.

However, if the terminal lead 110 is taut or nearly taut when connected to the spider 140 in this way, it may restrict or otherwise interfere with the excursion of the spider 140. Therefore, a length 120 of the terminal lead 110 that extends between the conductive coupler 114 and the connection point 118 on the spider 140 may be greater than a distance between the connection point 118 and the conductive coupler 114. This additional length 120, or slack, of the terminal lead 110 between connections may be referred to as a service loop 120, and may allow the spider 140 to flex as intended during operation of the loudspeaker 100. Additional service loops 120 may be included between each successive connection point 118 of the terminal lead 100 to the spider 140.

Accordingly, in some examples, the conductive coupler 114 may also serve to securely anchor the terminal lead 110 on one side of a service loop 120 that may be formed in the terminal lead 110. The length and shape of the service loop 120 may be determined based on the expected excursion of the diaphragm 108, the material of the diaphragm 108 and spider 140, among other factors. For instance, the service loop 120 may be sized large enough to accommodate the movement of the spider 140, yet not so large that the terminal lead 110 would shake excessively or bounce off of the spider 140, as discussed above. Thus, the ease of connecting the terminal lead 110 to the conductive clip 114 may also increase accuracy and consistency in forming service loops 120 in the terminal lead 110 having the desired length and shape.

In some examples, the loudspeaker 100 may include a coupler for connecting the terminal lead 110 and the voice coil lead 112 that is not conductive. Rather, a non-conductive coupler may be positioned at a pre-determined location and serve to hold the two leads in place, in conductive contact with one another, until soft solder is applied and a solder joint is formed around the connection. The non-conductive coupler might be plastic or another non-conductive material. Additionally or alternatively, the non-conductive coupler may be included as a part of one or more components of the loudspeaker 100. For instance, a loudspeaker diaphragm made of plastic might be fabricated with a clip integrally formed on its lower surface, in a predetermined location. The clip may provide a connection point for the terminal lead 110 and the voice coil lead 112, as discussed above. Other examples are also possible.

b. Example Implementations for Assembly of a Loudspeaker

Figure 3:
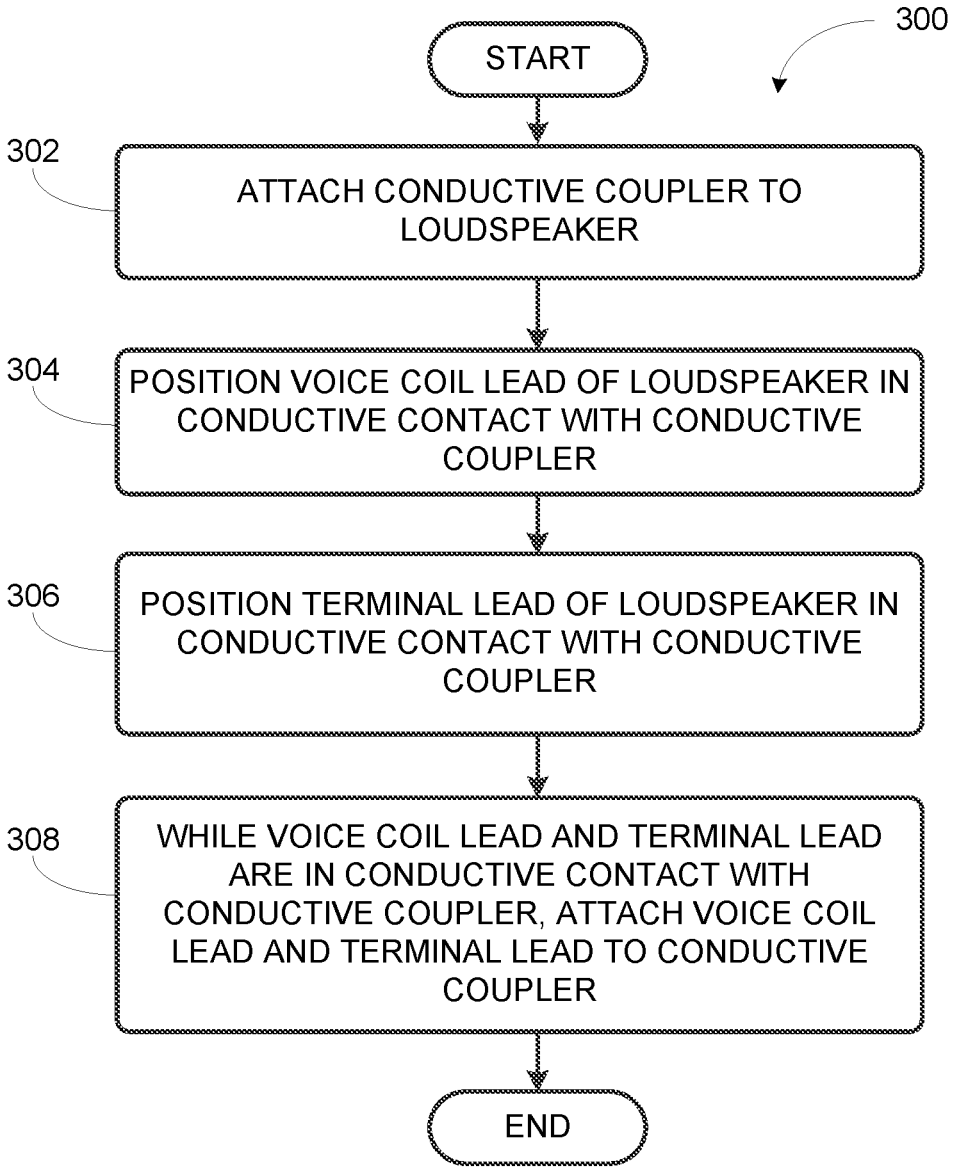
FIG. 3 shows an example flow diagram for assembly of a loudspeaker, according to an example embodiment.

The flow diagram 300 shown in FIG. 3 illustrates an example implementation for assembly of a loudspeaker, such as the loudspeaker 100 shown in FIGS. 1, 2A and 2B and discussed in the examples above.

At block 302 of the method 300, assembly of the loudspeaker 100 may involve attaching conductive coupler to the loudspeaker 100. The conductive coupler may be the conductive coupler 114 discussed in the examples above, and may include a mechanical clip as shown in the Figures. Other possibilities also exist. The conductive coupler 114 may be attached to the loudspeaker 100 as already discussed, in any number of locations including the inner diameter of the spider 140, as shown in the Figures.

At block 304 of the method 300, assembly of the loudspeaker 100 may involve positioning a voice coil lead of the loudspeaker 100, such as the voice coil lead 112 discussed above, in conductive contact with the conductive coupler 114. Similarly, block 306 of the method 300 may involve positioning a terminal lead of the loudspeaker 100, such as the terminal lead 110 discussed above, in conductive contact with the conductive coupler 114.

At block 308 of the method 300, the assembly may involve attaching the voice coil lead 112 and the terminal lead 110 to the conductive coupler 114 while the two leads are in conductive contact with the conductive coupler 114. As shown in FIG. 2B, attaching the voice coil lead 112 and the terminal lead 110 to the conductive coupler 114 may involve engaging a mechanical clip against the leads, and may additionally involve applying solder to the voice coil lead 112, the terminal lead 110 and the conductive coupler 114, creating a solder joint. In some instances, excess lead wire extending from the conductive coupler 114 after the attachment, as can be seen in FIG. 2B, may be trimmed and removed.

Alternatively, in other examples the conductive coupler 114 may includes a solder pad. In such cases, attaching the leads to the conductive coupler 114 may involve first adhering the leads to the solder pad using a solder paste, and then melting solder, including the paste, to the voice coil lead 112, the terminal lead 110 and the solder pad, creating a solder joint.

In some cases, the conductive coupler 114 may be attached to the loudspeaker 100 before positioning either the voice coil lead 112 or the terminal lead 110 in conductive contact with the conductive coupler 114, as discussed above. Alternatively, in some examples it may be desirable to attach the voice coil lead 112 and the terminal lead 110 to the conductive coupler 114 before the conductive coupler 114 is attached to the loudspeaker 100. In such an embodiment, the loudspeaker 100 may nonetheless include a pre-determined location for attachment of the conductive coupler 114 once the leads are attached, which may be indicated by a marking or other indication on the loudspeaker 100.

In some examples, assembly of the loudspeaker 100 may also include forming a gap, such as the gap 116, in the spider 140 at an outer diameter of the spider 140. As discussed above, the gap 116 provides a path for the terminal lead 110 to reach the conductive coupler 114, which is attached to the spider 140 in radial alignment with the gap 116. Thus, the assembly of the loudspeaker 100 may further include positioning the terminal lead 100 in the gap 116.

III. Conclusion

The description above discloses, among other things, various example systems, methods, apparatus, and articles of manufacture including, among other components, firmware and/or software executed on hardware. It is understood that such examples are merely illustrative and should not be considered as limiting. For example, it is contemplated that any or all of the firmware, hardware, and/or software aspects or components can be embodied exclusively in hardware, exclusively in software, exclusively in firmware, or in any combination of hardware, software, and/or firmware. Accordingly, the examples provided are not the only way(s) to implement such systems, methods, apparatus, and/or articles of manufacture.

As indicated above, the examples involve a pre-positioned conductive coupler for joining a terminal lead and a voice coil lead within a loudspeaker. In one aspect, a method of assembling a loudspeaker is provided. The method includes (i) attaching a conductive coupler to the loudspeaker, (ii) positioning a voice coil lead of the loudspeaker in conductive contact with the conductive coupler, (iii) positioning a terminal lead of the loudspeaker in conductive contact with the conductive coupler; and (iv) while the voice coil lead and the terminal lead are in conductive contact with the conductive coupler, attaching the voice coil lead and the terminal lead to the conductive coupler.

In another aspect, a loudspeaker is provided. The loudspeaker includes a conductive coupler, a voice coil having a voice coil lead, where the voice coil lead is positioned in conductive contact with the conductive coupler, and a terminal lead, where the terminal lead is positioned in conductive contact with the conductive coupler, and where the voice coil lead and the terminal lead are attached to the conductive coupler.

In yet another aspect, a loudspeaker is provided. The loudspeaker includes a frame, a voice coil suspended at least partially within a gap of a magnetic structure, where the magnetic structure is attached to the frame, and where the voice coil comprises a voice coil lead extending from the voice coil, a diaphragm coupled to the voice coil, a first suspension element attached circumferentially to an outer edge of the primary diaphragm, where the first suspension element is further attached to the frame, a second suspension element attached circumferentially to a lower surface of the primary diaphragm, where the second suspension element is further attached to the frame, a conductive coupler, and a terminal lead, where the terminal lead and the voice coil lead are positioned in conductive contact with the conductive coupler, and where the voice coil lead and the terminal lead are attached to the conductive coupler.

Additionally, references herein to "embodiment" means that a particular feature, structure, or characteristic described in connection with the embodiment can be included in at least one example embodiment of an invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

We claim:

1. A loudspeaker comprising:

a voice coil;

a voice coil lead extending from the voice coil;

a diaphragm coupled to the voice coil, wherein the diaphragm comprises an inner portion coupled to the voice coil, an outer edge, an intermediate portion between the inner portion and the outer edge, and a lower surface;

a suspension element comprising an inner diameter, wherein the inner diameter of the suspension element is attached circumferentially to the intermediate portion of the diaphragm at a lowest point on the lower surface of the diaphragm;

a conductive coupler attached to the suspension element at the inner diameter of the suspension element; and a terminal lead, wherein the terminal lead and the voice coil lead are conductively attached to the conductive coupler.

2. The loudspeaker of claim 1, wherein the conductive coupler comprises a mechanical clip, and wherein the voice coil lead and the terminal lead are conductively attached to the conductive coupler via engagement of the mechanical clip against the voice coil lead and the terminal lead.

3. The loudspeaker of claim 2 wherein the mechanical clip is bendable to engage the voice coil lead and the terminal lead.

4. The loudspeaker of claim 1, wherein the conductive coupler comprises a solder pad, and wherein the voice coil lead and the terminal lead are attached to the solder pad via a solder joint.

5. The loudspeaker of claim 1, wherein the inner portion, the outer edge, and the intermediate portion of the diaphragm are non-coplanar.

6. The loudspeaker of claim 1, wherein the voice coil comprises a top end, wherein the inner portion of the diaphragm is coupled to the top end of the voice coil, and wherein the intermediate portion of the diaphragm extends below the top end of the voice coil.

7. The loudspeaker of claim 1, wherein the terminal lead is further attached to a lower surface of the suspension element at a connection point, wherein a length of the terminal lead extending between the connection point and the conductive coupler is greater than a distance between the connection point and the conductive coupler.

8. The loudspeaker of claim 7, wherein the connection point is a first connection point, and wherein the terminal lead is further attached to the lower surface of the suspension element at a second connection point.

9. The loudspeaker of claim 1, wherein the suspension element comprises a gap at an outer diameter of the suspension element, wherein the conductive coupler is attached to the suspension element in radial alignment with the gap, and wherein the terminal lead is positioned in the gap.

10. The loudspeaker of claim 1, wherein the conductive coupler is attached to the suspension element via an adhesive.

11. The loudspeaker of claim 1, wherein the loudspeaker comprises two conductive couplers, each conductive coupler attached to the suspension element at a point on the inner diameter of the suspension element.

12. The loudspeaker of claim 10, wherein the two conductive couplers are positioned on opposite sides of the voice coil from each other.

13. The loudspeaker of claim 1, wherein the suspension element is a second suspension element, the loudspeaker further comprising:

a frame; and a first suspension element attached between the outer edge of the diaphragm and the frame.

14. The loudspeaker of claim 1, further comprising:

a magnetic structure, wherein the voice coil is at least partially suspended within a gap of the magnetic structure.

* * * * *